United States Patent [19]

Killinger et al.

[11] 4,372,234

[45] Feb. 8, 1983

[54] FRAME STRUCTURE FOR A BLINDSTITCH HEMMING MACHINE

[75] Inventors: Karl H. Killinger, Dover; Kenneth M. Johnson, Westfield; Peter J. Totino, North Bergen, all of N.J.

[73] Assignee: The Singer Company, Stamford, Conn.

[21] Appl. No.: 330,058

[22] Filed: Dec. 14, 1981

[51] Int. Cl.[3] ..... D05B 77/00

[52] U.S. Cl. ..... 112/258

[58] Field of Search ..... 112/176–178, 112/267.1, 268.1, 258, 259

[56] References Cited

U.S. PATENT DOCUMENTS

| | | | |
|---|---|---|---|
| 207,035 | 8/1978 | Hoffman et al. . | |
| 379,497 | 3/1888 | Thomson et al. . | |
| 1,009,408 | 11/1911 | Hagelstein . | |
| 1,042,537 | 10/1912 | Drake . | |
| 1,928,486 | 9/1933 | Gruman | 112/258 |
| 2,199,171 | 4/1940 | Gruman | 112/177 |
| 2,250,745 | 7/1941 | Buono | 112/178 |
| 2,743,688 | 5/1956 | Parry | 112/176 |
| 2,874,661 | 2/1959 | Parry et al. . | |
| 3,636,899 | 1/1972 | Crisler . | |

*Primary Examiner*—Werner H. Schroeder
*Assistant Examiner*—Andrew M. Falik
*Attorney, Agent, or Firm*—Robert E. Smith; Edward L. Bell

[57] ABSTRACT

A machine forming stitches invisible on one work face, with curved needle, looper, work feed, and associated drive mechanisms arranged beneath the work. After convenient assembly of these mechanisms on bosses rising from a frame base, a frame cover is attached carrying a presser and a device for forming a work ridge in the needle path. A compartment extending across this machine front is formed within the frame to accommodate the needle thread supply and controls.

3 Claims, 4 Drawing Figures

FRAME STRUCTURE FOR A BLINDSTITCH HEMMING MACHINE

DESCRIPTION

BACKGROUND OF THE INVENTION

This invention relates to sewing machines, and more particularly, to a blindstitch sewing machine, that is, a machine for producing stitches the threads of which enter and emerge from the back side of the work without surfacing and thus being invisible from the front or exposed side of the work.

Blindstitch sewing machines presently known in the art are expensive, special purpose, industrial machines intended for use primarily by trained operators, tailors, or the like. Not only does the cost deter use of known blindstitch sewing machines by occasional or untrained operators familar only with household sewing machines, but also the rather striking differences in arrangement and operation of the blindstitching instrumentalities as compared with those of household sewing machines, as well as differences in the mode of threading of the stitch forming instrumentalities and differences in the disposition of work fabrics as they are directed to the point of stitch formation.

The present invention not only provides a novel organization of parts in a blindstitch hemming machine which makes possible great economy in the manufacture of parts and in the assembly thereof so as to reduce the cost of a blindstitch machine to a level well within a range affordably by an occasional non-professional user; but also facilitates threading, work handling, and the aspect of an operator of the blindstitch machine with respect to the stitch forming instrumentalities so as to minimize the differences from conventional household sewing machines and thus facilitate the use thereof by an occasional sewer.

This invention contemplates a blindstitch sewing machine having a two part frame including a base portion with a substantially planar walled floor from which a plurality of bosses rise for supporting the blindstitching mechanism which comprises essentially, a thread carrying endwise reciprocatory needle, a thread manipulating looper, and a work feeding mechanism as well as a main drive shaft with actuators for the blindstitching mechanism and an electric motor with drive connections to the main shaft. This base portion construction provides not only for high dimensional stability for the blindstitching mechanism but for facility of assembly thereof into the base portion prior to placement thereon of a cover portion including a low section extending from one side to the other across the entire front of the cover portion, a high rear section, a sloping ramp section joining the front and rear sections and walls depending from at least the sides and rear of the cover portion mating congruently with the walls of the base portion. A throat plate is carried at one side of the frame adjacent the low section of the cover portion, and across the front of the machine frame an access opening is formed between the base and cover portions adapted to be closed or opened selectively by a shiftable cover and adapted to accommodate on that side opposite the throat plate, a thread spool holder, thread controlling instrumentalities and thread guides, and adapted to accommodate the thread carrying needle of the blindstitching mechanism beneath the throat plate, so that threading may be accomplished directly across the front of the machine in full and direct view of the machine operator. A presser arm pivotally secured at the opposite side of the frame from the throat plate on the high rear section of the frame cover portion, projects forwardly from the high rear section of the cover portion, has a thickness dimension substantially equal to the difference in height of said low and high cover portion sections and carries a presser device for urging work fabric against the throat plate as well as a ridge former for projecting a bight of work fabric through the throat plate aperture. With this construction, the blindstitch forming mechanism which is strange to most users of household sewing machines and apt to detract from their attention during operation, is hidden from view by the presser arm and the low silhouette of the presser arm does not detract the operator's view of the flow of work through the blindstitch sewing machine.

BRIEF DESCRIPTION OF THE DRAWINGS

With the above and additional objects and advantages of this invention in view, as will hereinafter appear, this invention comprises the devices, combinations and arrangement of parts hereinafter described and illustrated in a preferred embodiment shown in the accompanying drawings in which:

Referring to FIG. 3, a frame base portion 11, and a frame cover portion 12 which together form the two-part frame for the blindstitch sewing machine of this invention are illustrated separately and without any mechanism or parts applied thereon.

Figure 1:
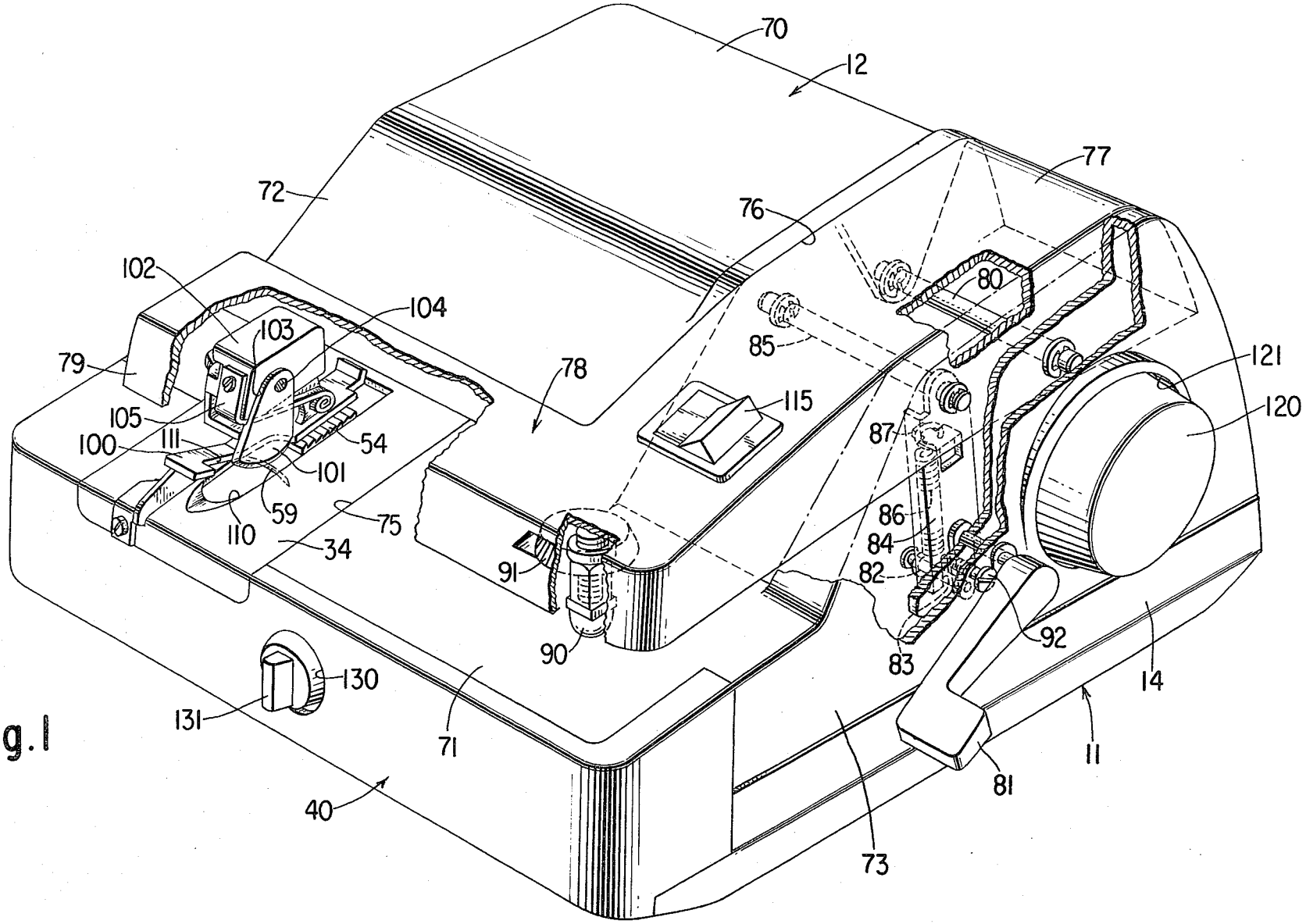
FIG. 1 is a right front perspective view of a blindstitch sewing machine of this invention with the parts arranged in position for sewing and with portions of the presser arm, presser device, and frame cover portion broken away more clearly to illustrate mechanism therein.

The frame base portion 11 is formed with a generally square planar floor 13 from which rise sidewalls 14, 15 and a rear wall 16. Also rising from the floor 13 of the frame base portion 11 are a plurality of bosses including bosses 17 adapted to accommodate fastenings 18 for securing the frame cover portion 12 thereto; bosses 19 adapted, as shown in FIG. 4, to accommodate bearings 20 and retainer clips 21 for rotatably supporting a main drive shaft 22; a boss 23 accommodating the drive motor 24 for the main drive shaft; bosses 25 adapted to accommodate bearings 26 which may also be secured by retainer clips 21 for supporting a needle reciprocating mechanism 27; a boss 28 providing support for the looper mechanism 29 and the work feeding mechanism 30; a boss 31 accommodating a thread tensioning device 32; and bosses 33 adapted to accommodate a throat plate 34.

Figure 2:
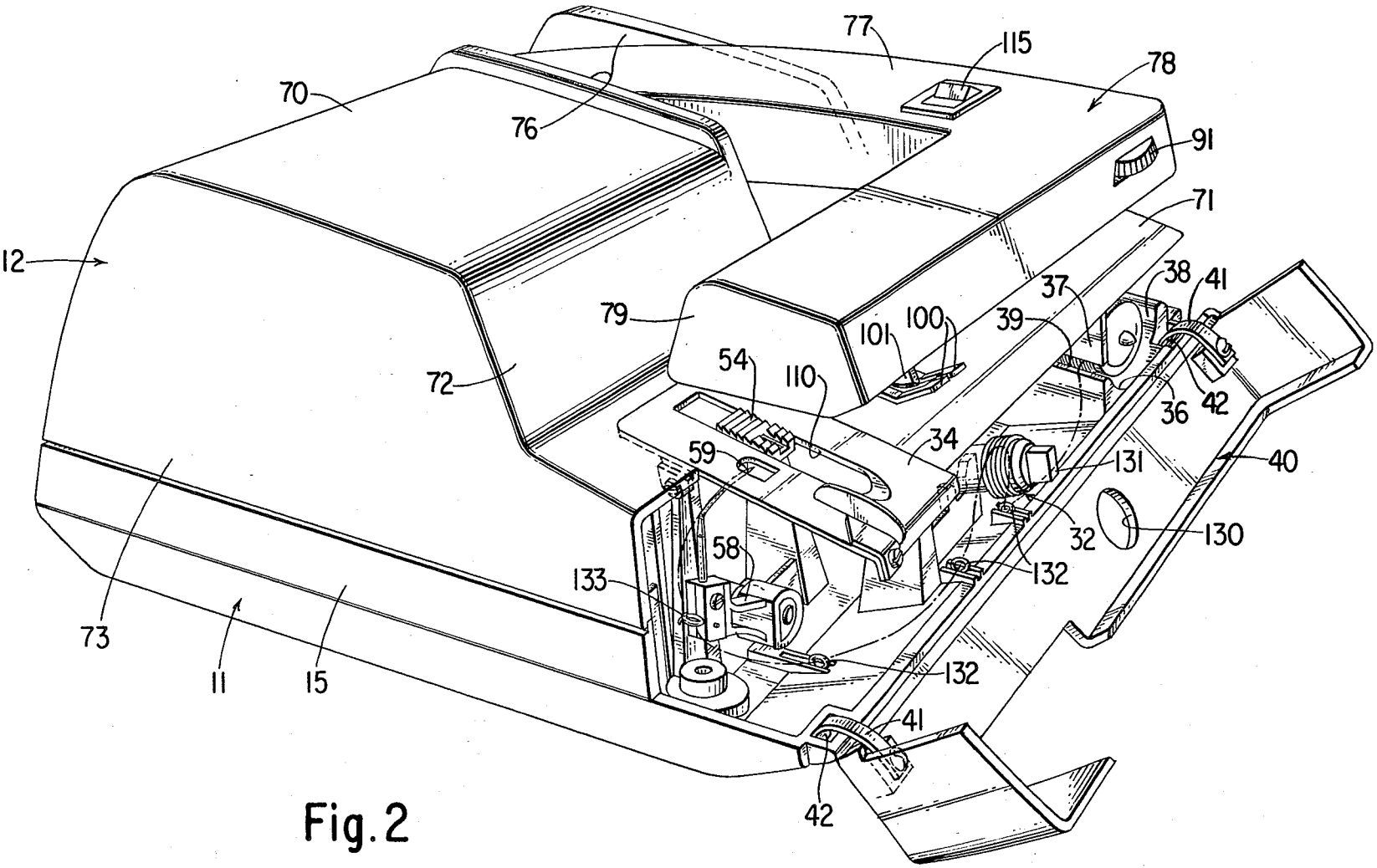
FIG. 2 is a left front perspective view of the blindstitch sewing machine of this invention showing the presser arm raised as for removal and insertion of work and the front access cover opened as for threading of the needle.

The frame base portion 11 is also formed with a transverse internal partition 35 rising from the floor to define a forwardly open compartment extending across the machine when all the parts are assembled. A curved divider 36 extends forwardly from the transverse partition and cooperates with a depending divider 37 on the frame cover portion 12 to define a thread spool accommodating compartment 38 in the machine frame with the slot 39 between the dividers 36 and 37 providing for egress of thread as shown in FIG. 2. A cover 40 is provided as shown in FIGS. 1, 2 and 3 for selectively opening and closing the forwardly open frame compartment, preferrably the cover 40 being provided with resilient hinge elements 41 cooperating with sockets 42 formed one at each side of the frame base portion.

Figure 4:
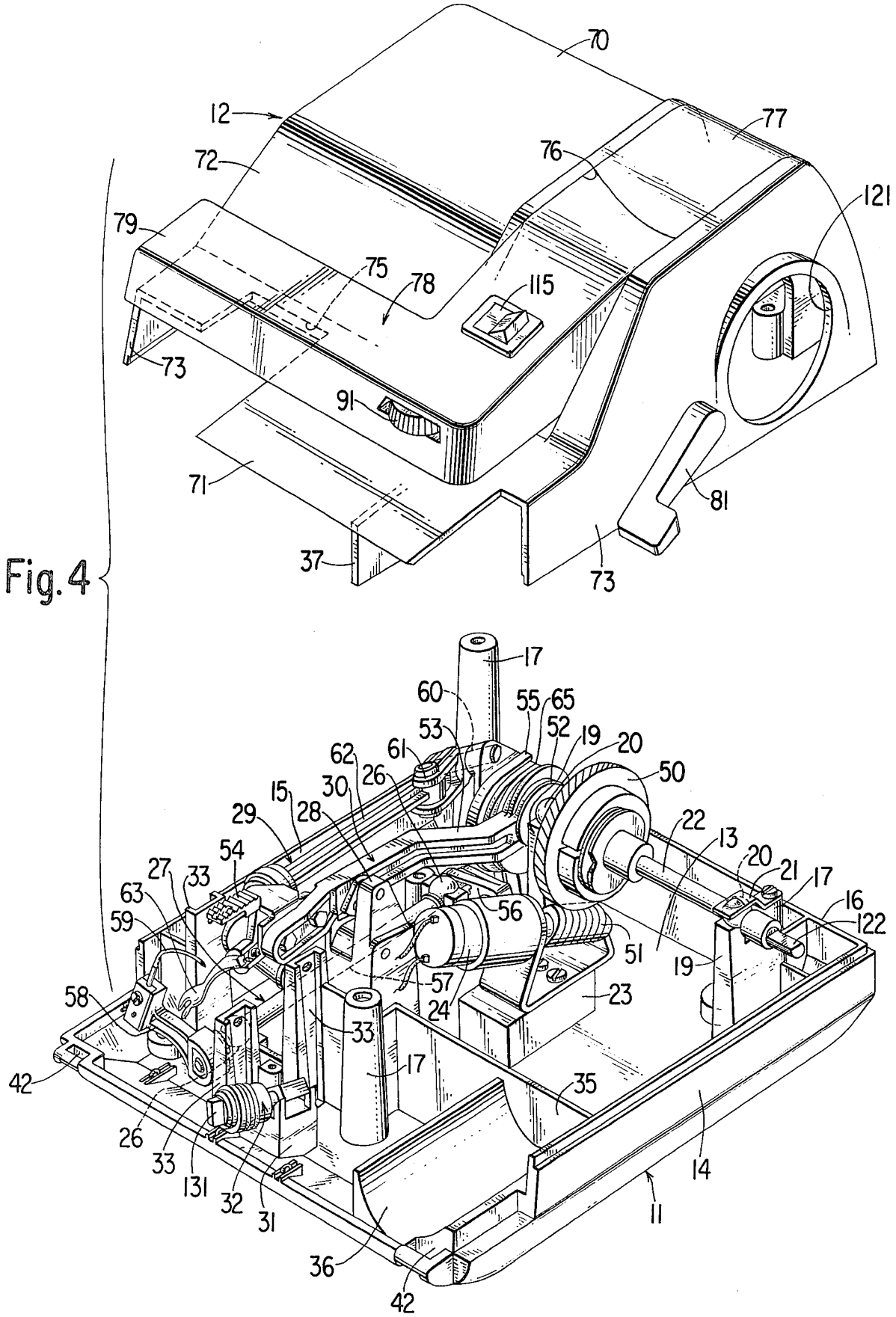

Referring to FIG. 4, the stitch forming mechanism of the blindstitch sewing machine as well as the drive mechanism therefor is illustrated assembled in operative relation on the frame base portion. The specific details of construction of the stitch forming mechanism and drive mechanism are not critical to this invention since other known types of these elements may be substituted; what is important to this invention is that these elements may be completely assembled in operative relation to each other on the bosses rising from the frame base portion 11 while the frame cover portion 12 is removed. As a result, an advantageously strong and dimensionally stable support is provided for the mechanism and the assembly thereof is greatly facilitated.

The mechanism illustrated in FIG. 4 includes a worm wheel 50 carried by the main drive shaft 22 meshing with a worm 51 driven by the motor 24. Three actuating elements are carried by the main drive shaft. First, an eccentric 52 for driving the work feeding mechanism 30 which is embraced by one end of a feed bar 53 of which the other end carries a feed dog 54; second, an eccentric 64 for driving the needle reciprocating mechanism 27 which is embraced by a pitman 55 pivotally connected to a crank 56 fast on a needle reciprocating shaft 57 which carries a rock arm 58 to which a curved needle 59 is clamped; and third, an inclined crank pin 60 for driving the looper mechanism 29 which has a swivel connection 61 to a looper carrier 62 to which a looper 63 is secured.

Figure 3:
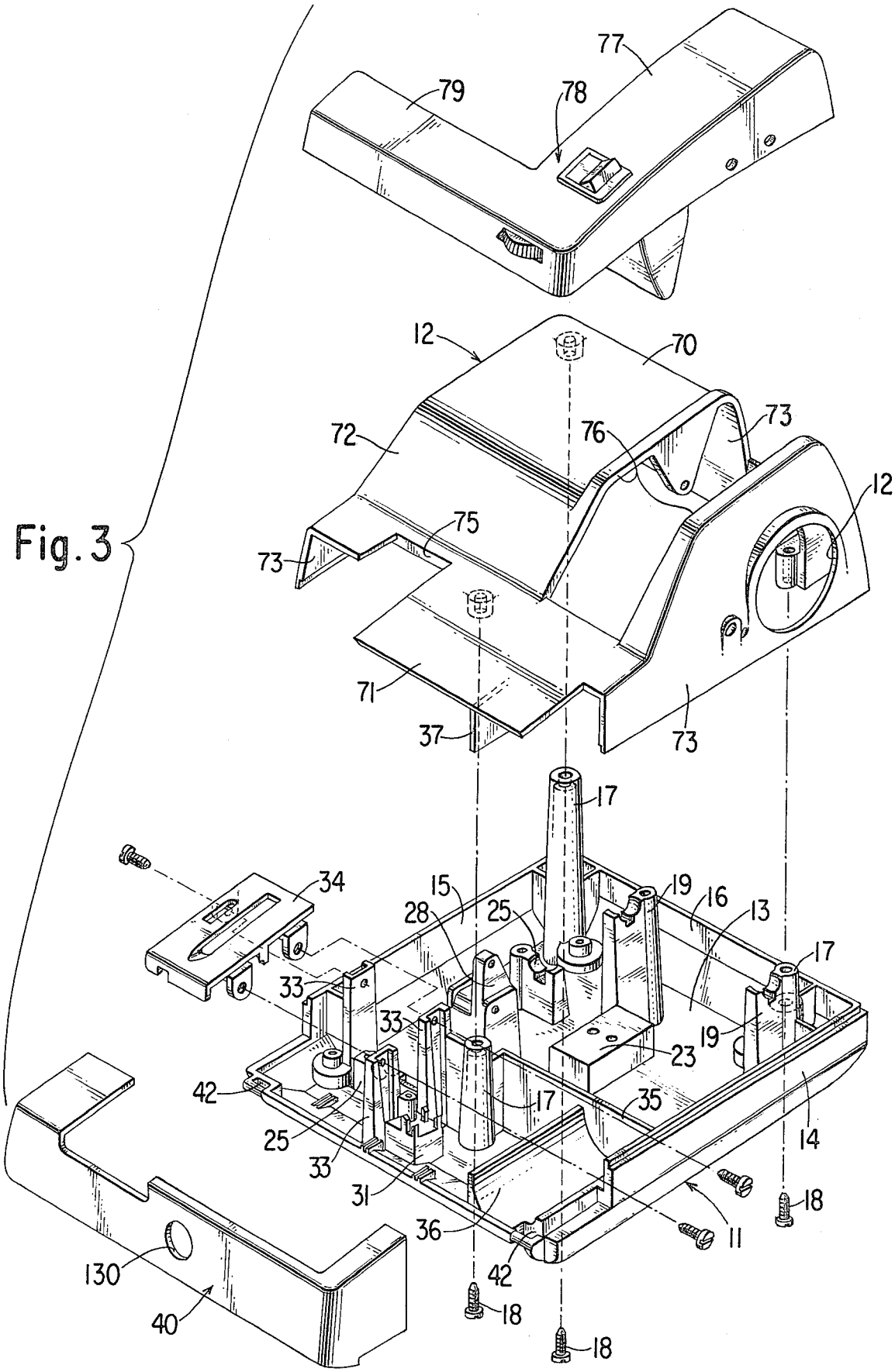
FIG. 3 is an exploded perspective view of the frame parts of the blindstitch sewing machine of this invention including the frame base and cover portions, the presser arm and the front access cover together with the throat plate; and, FIG. 4 is an exploded perspective view of the frame base portion showing the stitch forming and drive mechanisms assembled therein and the frame cover portion with the presser arm assembled thereon.

FIG. 3 illustrates the frame cover portion 12 prior to the assembly thereon of any other parts and prior to its assembly onto the frame base portion 11. The frame cover portion 12 is formed with a high rear section 70, a low front section 71, a sloping ramp 72 joining the front and rear sections and walls 73 depending from the sides and rear of the cover portion and adapted to mate congruently with the side and rear walls 14, 15 and 16 of the frame base portion 11. The low front section 71 of the frame cover portion 12 is formed with a recess 75 to accommodate the throat plate 34. The high rear section 70 and the sloping ramp 72 and the rear wall 73 at the side opposite the throat plate accommodating recess 75 are formed with a slot 76 adapted snugly to accommodate the rearwardly extending arm 77 of a presser arm 78 having a laterally extending arm 79 adapted to occupy a position over the throat plate when the presser arm is assembled on the blindstitch machine frame.

FIGS. 1, 2 and 4 illustrate the presser arm assembled in place on the frame cover portion, and FIG. 1 provides the clearest illustration of the details of construction of the presser arm 78 and the mechanism carried thereby. The rear extension 77 of the presser arm 78 is pivotally secured to the frame top cover 12 by a pivot pin 80. A level 81 journalled in the frame cover portion side wall 73 carries a crank pin 82 which traverses a slot 83 in a connecting link 84 pivotally secured to a pin 85 in the presser arm 78. The crank pin 82 is also connected to a tension spring 86 anchored on a tab 87 struck out from the connecting link. When the lever 81 is lifted i.e., turned in a clockwise direction as viewed in FIG. 1, the crank pin 82 engaging the top of the slot 83, will lift the connecting link 84 and the presser arm 78 so as to facilitate insertion and removal of work thereunder. An adjustable stop abutment 90 in the presser arm which may be shifted by a thumb nut 91 determines the lowered operative position of the presser arm 78. When the lever 81 is lowered, i.e., turned in a counterclockwise direction as viewed in FIG. 1, the crank pin 82 will distend the tension spring 86 and move across the centerline between the axes of the crank pin 82 and the pivot pin 85 and against a stop abutment on the frame such as a stop screw 92 to maintain the presser arm in a stable condition biased downwardly by the tension spring 86.

Also illustrated in FIG. 1 is one of the pair of presser feet 100 (the other being deleted for clarity) and the ridge former 101 which is supported between the presser feet. A support block 102 adapted to be secured beneath the lateral arm 79 of the presser arm 78 is formed with a seat 103 into which the ridge former 101 is rigidly secured as by a fastening screw 104. A leaf spring 105 secured at one end to the support block 102 is connected at the other end to the presser foot 100 so that while the ridge former 101 can move relatively to the throat plate only with movements of the presser arm, i.e., by flexing of the tension spring 86, the presser feet 100 are independently yieldable by virtue of the leaf springs 105 to hold work fabric against the throat plate despite movements of the ridge former and presser arm in response to cross seams, additional fabric plies or the like.

The throat plate 24, as shown in FIGS. 1 and 3, is formed with an elongated opening 110 through the front portion of which the ridge former is positioned to extend downwardly. The feed dog 54 is positioned to work upwardly through the rear portion of the opening 110 and as shown in FIG. 1, each presser foot 110 is formed sufficiently wide so as to extend over both the feed dog as well as the throat plate adjacent to the opening 110, there being a notch 111 formed in each presser foot 100 to accommodate the ridge former 101.

The presser arm 78 may also carry an electric switch 115 for turning on or off the drive motor 24 although the switch 115 might be located elsewhere on the blindstitch machine.

As shown in FIG. 4, the assembly of parts onto the frame base portion 11 prior to placement of the frame cover portion 12 thereon, does not include the handwheel 120. The frame cover portion 12 is formed with an access hole 121 for the hand wheel and the main drive shaft 22 is formed with a non-circular extremity 122 adapted to accommodate assembly of the handwheel 120 thereon as by a force fit after the frame cover portion has been placed and fastened on the frame base portion.

Referring to FIGS. 1 and 2, which illustrate the shiftable cover 40 in closed and open positions respectively, the cover 40 is preferrably formed with an opening 130 through which an adjusting knob 131 on the thread tension device 31 projects when the cover 40 is closed. In FIG. 2, the thread spool compartment 38 thread egress slot 39 therein, thread tension device 32 thread guides 132 on the frame base portion 11, and a thread guide 133 on the needle supporting rock arm 58 are illustrated together with a thread shown in dot-dashed line being directed to the needle.

Threading is facilitated with the blindstitch machine of this invention because the entire thread path from thread spool to needle proceeds across the front of the machine in direct view of the operator when the cover is opened. The thread path is protected from interference with the operator or with work fabrics being sewn when the cover is closed.

As shown in FIGS. 1 and 2, the height of the lateral arm 79 of the presser arm 78 is substantially equal to the difference in height of the high and low sections 70, 71 of the frame cover portion 12 so that as the flow of work fabrics progresses over the frame cover portion and beneath the presser arm, the low silhouette provided by the rectangular box-like form of the machine does not detract the operator's view of the work nor does it hinder the operator's manipulation of the work fabrics.

We claim:

1. A blindstitch sewing machine comprising: a two part frame including a base portion and a cover portion mating congruently therewith, said base portion including a substantially planar floor, walls rising from at least the sides and rear of said floor, and a plurality of bosses rising from said floor for supporting blindstitching mechanism thereon, said cover portion including a low section extending from one side to the other across the entire front of said cover portion, a high rear section, a sloping ramp section joining said front and rear sections, and walls depending from at least the sides and rear of said cover portion, a throat plate carried at one side of the two part frame adjacent the low section of said cover portions and formed with an aperture for accommodating a work fabric bight projecting herethrough into the path of blindstitch forming instrumentalities supported within said frame base portion, a presser arm pivotally secured at the opposite side of the two part frame from the throat plate on the high rear section of said frame cover portion, said presser arm projecting forwardly from said high rear section of said cover portion extending over said low section of said cover portion, and having a thickness dimension less than the difference in height of said low and said high cover portion sections, a presser device carried by said presser arm for urging work fabrics against said throat plate, and a ridge former carried by said presser arm for projecting a bight of work fabric through said throat plate aperture.

2. A blindstitch sewing machine as set forth in claim 1 in which:

said base portion and said cover portion of said two part frame are formed with an access opening between the parts, said access opening extending across the front of said frame and beneath the low section of said cover portion, in which a thread spool holder, thread controlling instrumentalities, and thread guides are arranged within said access opening at that side of said frame opposite said throat plate, in which a thread carrying needle of said blindstitching mechanism is arranged in said access opening beneath said throat plate, and in which a cover means is shiftably supported on said two part frame for selectively opening and closing said access opening.

3. A blindstitch sewing machine comprising: a two part frame including a base portion and a cover portion mating congruently therewith said base portion including a substantially planar floor, blindstitching mechanism including a thread carrying endwise reciprocable needle, a thread manipulating looper, and a work feeding mechanism, drive means for said blindstitching mechanism including, a main drive shaft with actuators thereon for said blindstitching mechanism, and an electric motor with drive connections to said main drive shaft, a plurality of bosses rising from the floor of said frame base portion, said blindstitching mechanism and said drive means therefor being accommodated in assembled cooperative relation on said plurality of bosses in said frame base portion while said cover portion is removed, fastening means for securing said cover portion to said base portion, and a ridge former device cooperating with said blindstitching mechanism and carried by said frame cover portion.

* * * * *